US005648802A

United States Patent [19]

Abe

[11] Patent Number: 5,648,802

[45] Date of Patent: Jul. 15, 1997

[54] CAP FOR AN INK JET RECORDING HEAD

[75] Inventor: Tsutomu Abe, Isehara, Japan

[73] Assignee: Canon Kabushiki Kaisha, Tokyo, Japan

[21] Appl. No.: 393,251

[22] Filed: Feb. 23, 1995

Related U.S. Application Data

[63] Continuation of Ser. No. 820,488, Jan. 14, 1992, abandoned.

[30] Foreign Application Priority Data

Jan. 18, 1991 [JP] Japan ..... 3-004707

[51] Int. Cl.[6] ..... B41J 2/165

[52] U.S. Cl. ..... 347/29

[58] Field of Search ..... 347/22, 29, 30, 347/31, 32, 33, 86, 87

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,571,601 | 2/1986 | Teshmia | 347/33 |
| 4,723,129 | 2/1988 | Endo et al. | 347/56 |
| 4,740,796 | 4/1988 | Endo et al. | 346/1.1 |
| 4,951,066 | 8/1990 | Terasawa et al. | 347/30 |
| 5,131,539 | 7/1992 | Karita et al. | 347/87 |
| 5,214,447 | 5/1993 | Iwata | 347/30 |

FOREIGN PATENT DOCUMENTS

| | | | |
|---|---|---|---|
| 0418828 | 3/1991 | European Pat. Off. . | |
| 54-56847 | 5/1979 | Japan . | |
| 59-14962 | 1/1984 | Japan | 347/29 |
| 59-123670 | 7/1984 | Japan . | |
| 59-138461 | 8/1984 | Japan . | |
| 60-71260 | 4/1985 | Japan . | |
| 60-204348 | 10/1985 | Japan . | |
| 61-37436 | 2/1986 | Japan . | |
| 61-125851 | 6/1986 | Japan . | |
| 62-019460 | 1/1987 | Japan . | |
| 63-12149 | 1/1988 | Japan . | |
| 3176156 | 7/1991 | Japan . | |
| WO9108269 | 6/1991 | WIPO . | |

*Primary Examiner*—John E. Barlow, Jr.

*Attorney, Agent, or Firm*—Fitzpatrick, Cella, Harper & Scinto

[57] ABSTRACT

A cap installed in an ink jet recording head for sealing an ink ejection orifice of the ink jet recording head comprises a contacting member and a pressing structure. The contacting member is a member having an elastically deformable convex part which contacts a face on which the orifice is disposed and seals the orifice. The pressing structure presses the convex part of the contacting member toward the face in responsive to installing the cap.

28 Claims, 16 Drawing Sheets

CAP FOR AN INK JET RECORDING HEAD

This application is a continuation of application Ser. No. 07/820,488, filed Jan. 14, 1992 abandoned.

BACKGROUND OF THE INVENTION

1. Field of the Invention

The present invention relates to a cap for a recording head used for sealing tightly an ink ejection orifice of an ink jet recording head so as to protect the orifice, and an ink jet recording head in which the cap for a recording head can be mounted.

2. Description of the Related Art

One of the most important factors which determine the reliability in recording information by ink jet recording heads is a physical condition around the ink ejection orifice (hereinafter referred to as "orifice" simply) and a physical condition of ink fluid to be ejected outside the orifice. More specifically, extraneous substances such as dust and liquid drops on and around the orifice may deflect an ink drop let being ejected, and an increase in viscosity of ink in a liquid path near the orifice may lead an ink ejection to be faulty condition such as non-ejection. An attachment of such unfavorable extraneous substances and such increase in viscosity of ink fluid occur when the orifice of the recording head is exposed to the atmospheric air, for example, during ejecting ink for recording information or waiting for recording operation. It is known that, in order to prevent the attachment of such unfavorable extraneous substances and such increase in viscosity of ink, the orifice is capped with an adequate device except when the orifice is used for recording operation or the like, or the surface on which the orifice is disposed is wiped with a blade and so on according to demand.

It is easier to remove unfavorable extraneous substances by way of the above mentioned devices in case that the recording head is installed in the recording apparatus. However, in case that the recording head is shipped and transported from the factory to users through temporary storages, it may be required that some preventive method for removing unfavorable extraneous substances on the recording head and for reducing an increase of the viscosity of ink fluid should be employed.

Especially in case of exchangeable recording heads which can be installed in and removed from the apparatus body freely, as storage and transportation of such exchangeable recording heads are directed to an individual recording head separated from the recording apparatus, the above mentioned device for capping the recording head installed in the recording head cannot be directly applicable.

In addition to the above mentioned problems in removing unfavorable extraneous substances and preventing an increase in the viscosity of ink fluid, it is required to prevent ink fluid leakage due to external force and shock while transporting the recording head and due to a temperature change outside the recording head. In order to solve these problems, in some prior art apparatus, employed is a cap the structure of which is different from that used in the apparatus when installed. An example of such a cap is shown below.

As shown in FIG. 1, in Japanese Patent Application Laying-open No. 37436/1986, disclosed is a structure where a cap 70 covers the whole surface on which orifices 71*a* of the recording head 71 are arranged so that a swelling material inside the cap 70 absorbs ink fluid from the orifices 71*a* and swells so as to seal the orifices 71*a*. Alternatively, FIGS. 2A, 2B and 2C also show a structure where a seal 80 is bonded on the surface on which orifices 81*a* of the recording head 81 are arranged so that the orifices 81*a* are sealed.

And furthermore, with a combination of a seal 90*c* and a pressing member 90*b* as shown in FIGS. 3A and 3B, by the assignee, proposed is a structure 90 where the seal 90*c* is pressed against the face 91*a* on which an orifice 91*e* of the recording head 91 is disposed. The structure is disclosed in WO/91/08267.

In this structure, the seal 90*c* which is larger than the orifice disposed face 91*a* is bonded onto the orifice disposed face 91*a* by using bonding materials with relatively weaker adhesive property. The bonded seal 90*c* is pressed by the pressing member 90*b* with a designated amount of force developed on the face around the orifices 91*e* on the orifice disposed face 91*a*. As a result, the orifices 91*e* are shielded completely against the atmospheric air and evaporation of ink fluid from the orifices 91*e* is prevented. A pressing force developed by the pressing member 90*b* is applied by means that a couple of arms of the cap 90*a* is caught by a part of the recording head 91 when the cap 90*a* is installed in the recording head 91.

Bonding materials used for contacting the seal 90*c* and the orifice disposed face 91*a* have a weak adhesive property as described above. That is, there is no need to guarantee complete sealing of the orifices by bonding the seal 90*c* itself, and hence, the seal 90*c* may have an adequate adhesive property so as to establish contacting of the seal 90*c* on the orifice disposed face. So far, it will be appreciated that the amount of bonding materials can be limited to be small enough to establish contacting of the seal 90*c* on the orifice disposed face and that unfavorable penetration of excess bonding materials into the orifices can be avoided so that bonding materials may not give unfavorable effect on ink ejection operations.

In the above mentioned structures for capping the recording head, the following problems still remain to be unsolved. In the structure using the cap 70 shown in FIG. 1, though ink fluid leakage is prevented even when external force and shock are applied or excess amount of temperature changes occur, there may be a case that leaked ink fluid from the orifices 71*a* is staying in a space between the swelling material in the space 71*b* and the cap 70. In this case, for example, when the cap 70 is removed in order to install the recording head in the recording apparatus by the user, ink fluid remained in the space may flow over the cap 70 and may be spattered over hands of the user, and even may lead to electric parts failure due to spilled ink fluid in the recording apparatus.

In the structure using the seal 80 as shown in FIGS. 2A–2C, it may not be easy to install the seal 80 on and around the orifices of the recording head precisely. When removing the seal 80 installed on the orifice disposed face, strong bonding materials used for contacting the seal 80 may be still present on the face near the orifices so that ink fluid ejection failure may be brought. On the other hand, when bonding materials with weak adhesive property is used, the seal of the recording head by the seal 80 is not completely established. And in case that the surface of the orifices is not continuously formed on its neighboring area, the seal 80 cannot seal the surface and its neighboring area completely.

Even in the structure as shown in FIGS. 3A–3C, in case that the surface 91*a* of the orifices 91 is not continuously formed on its neighboring area and the surface 91*a* is concave on the neighboring area, it may not be easy to bring the seal 90c into close contact with the orifices 91e by the pressing member 90b. These contact failure leads to incomplete seal to the orifices.

For example, in case that the orifice disposed face to be shown in FIG. 8 of the present invention where a cross-sectional shape of the orifice disposed face is a concave (arc) shape and the orifices is not placed in the bottom of the concave shape, the distribution of pressing force developed by the pressing member is not uniform over the concave shape because the shape of the contacting face of the pressing member 90b is a flat plane. That is, there may be a case that pressing member 90b cannot be deformed in responsive to the curved shape of the orifice disposed face and that, as a result, a well-conditioned contact between the seal 90c and the orifices 91e cannot be established.

In addition, in the structure shown in FIGS. 3A–3C, the pressing member 90b is composed of elastic and porous materials such as silicon porous materials and polyurethane porous materials which have a thickness of about three millimeters. In this case, as the pressing member 90b has about 50 cells of air voids per 1 inch, seven to eight orifices may be defined in the corresponding cell. These orifices contacting cells of air voids are not pressed directly by the substantial pressing member 90b through the seal 90c, and these orifices are pressed only by the seal 90c. As a result, which leads to unfavorable phenomena such as an increase in the viscosity of ink fluid absorbed in the pressing member 90b and spilt ink fluid around the orifices.

Furthermore, in the above mentioned structure of sealing and capping the recording head, there may be a problem that the number of additive components for sealing and capping the recording head inevitably increases.

SUMMARY OF THE INVENTION

An object of the present invention is to provide a cap for a recording head which can seal tightly an ink ejection orifice and its neighboring part of the ink jet recording head, and an ink jet recording head which can use the cap.

In a first aspect of the present invention, a cap which can be installed in an ink jet recording head for sealing an ink ejection orifice of the ink jet recording head, comprises:

- a contacting member having an elastically deformable convex part, the convex part contacting a face at which the ink ejection orifice is disposed and sealing the ink ejection orifice; and
- a pressing means for pressing the convex part of the contacting member toward the face by means of the installation of the cap.

In a second aspect of the present invention, a container for storing an ink jet recording head, comprises:

- a contacting member having an elastically deformable convex part, the convex part contacting a face at which an ink ejection orifice of the ink jet recording head is disposed and sealing the ink ejection orifice; and
- a pressing means for pressing the convex part of the contacting member toward the face by means of storing the ink jet recording head.

In a third aspect of the present invention, an ink jet recording head for ejecting ink, comprises:

- a cap for sealing an ink ejection orifice of the ink jet recording head, the cap installed in the ink jet recording head so as to be removable from the ink jet recording head, the cap comprising:
  - a contacting member having an elastically deformable convex part, the convex part contacting a face at which the ink ejection orifice is disposed and sealing the ink ejection orifice; and
  - a pressing means for pressing the convex part of the contacting member toward the face by means of the installation of the cap.

The above and other objects, effects, features and advantages of the present invention will become more apparent from the following description of embodiments thereof taken in conjunction with the accompanying drawings.

BRIEF DESCRIPTION OF THE DRAWINGS

Embodiments of the invention will now be described, by way of example and with reference to the accompanying drawings in which.

As will be described, these and other features of the present invention and one embodiment of it are more fully described below in the detailed description and with the accompanying drawings.

DETAILED DESCRIPTION OF PREFERRED EMBODIMENTS

Figure 1:
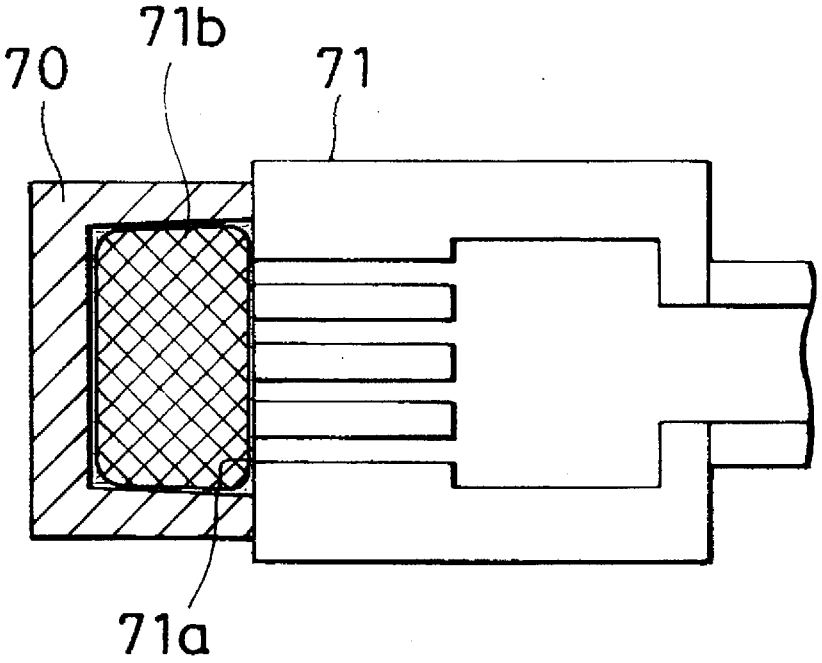
FIG. 1 (PRIOR ART)
FIG. 1 is a schematic cross-sectional view of a recording head and a cap sealing the recording head of prior art.
Figure 2C:
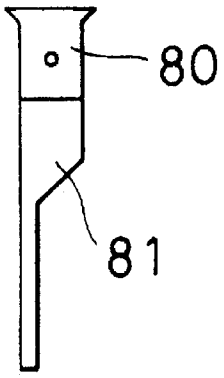
FIG. 2C is a side view of the recording head and the cap shown in FIGS. 2A and 2B.
Figure 2B:
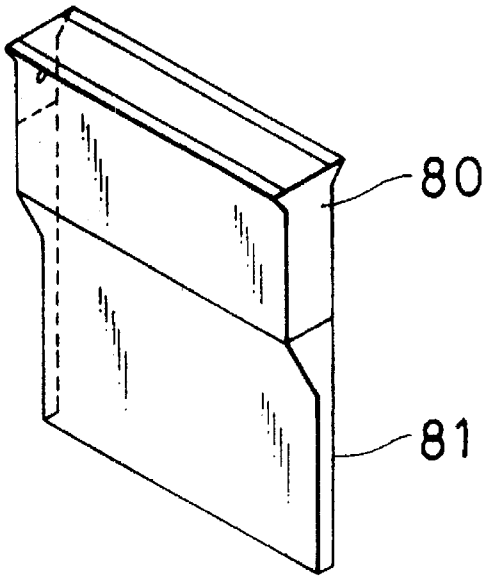
FIGS. 2A and 2B are perspective views of a recording head and a cap sealing the recording head of related art.
Figure 2A:
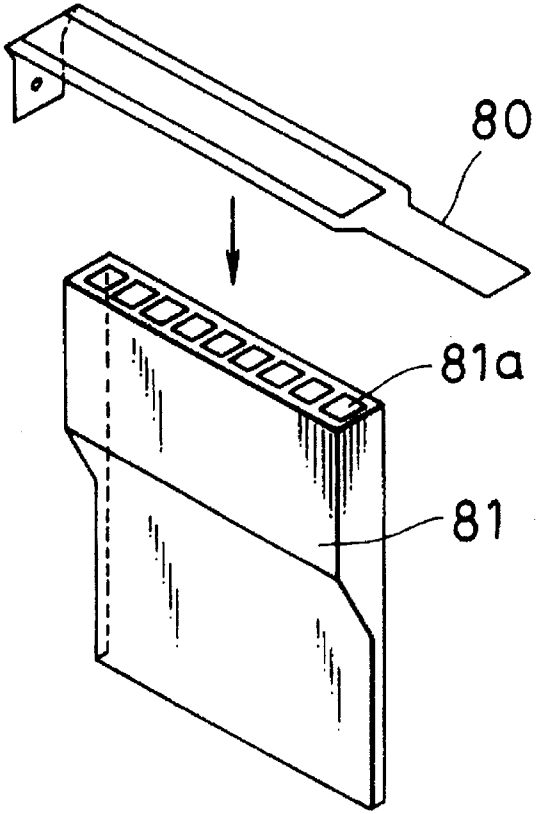
Figure 3A:
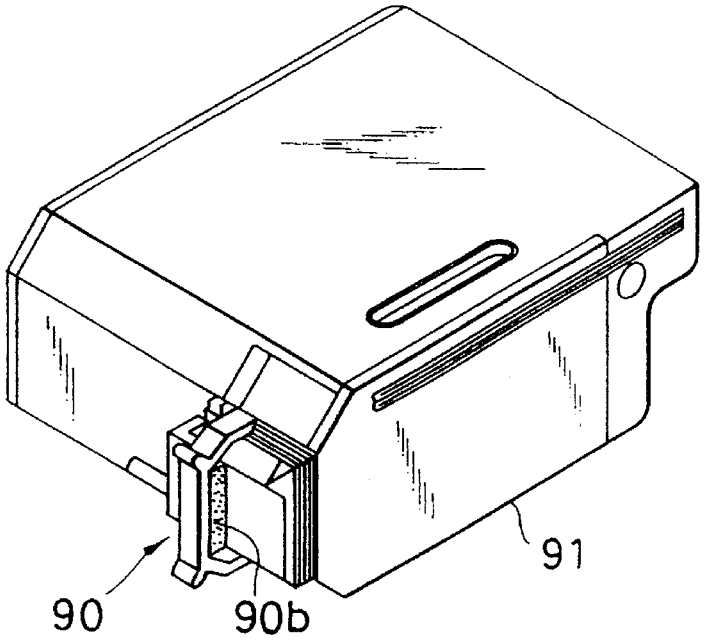
FIGS. 3A and 3B are perspective views of a recording head and a cap sealing the recording head of related art.
Figure 3B:
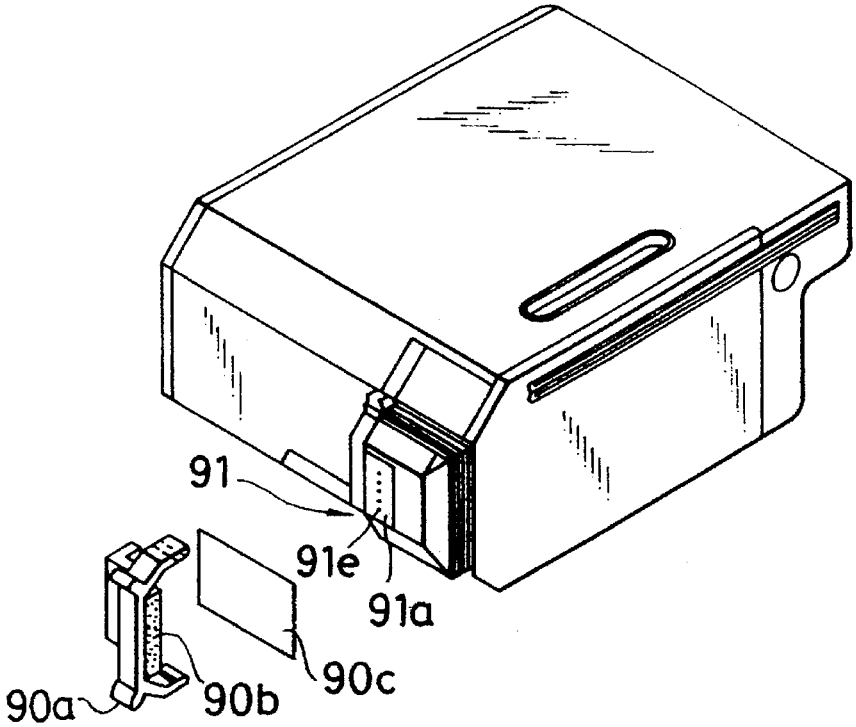
Figure 4:
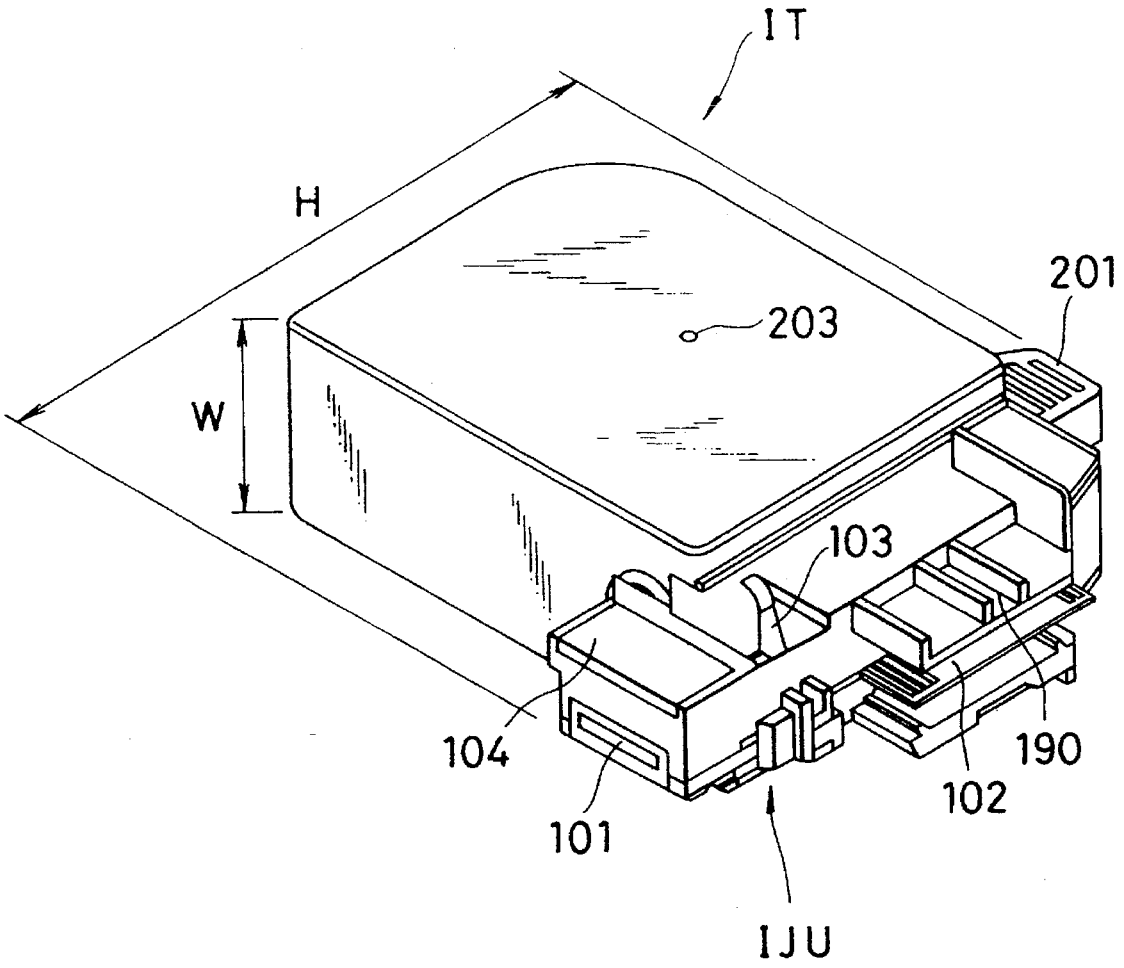
FIG. 4 is a perspective view of an ink jet recording head which can mount a cap of an embodiment of the present invention.
Figure 13:
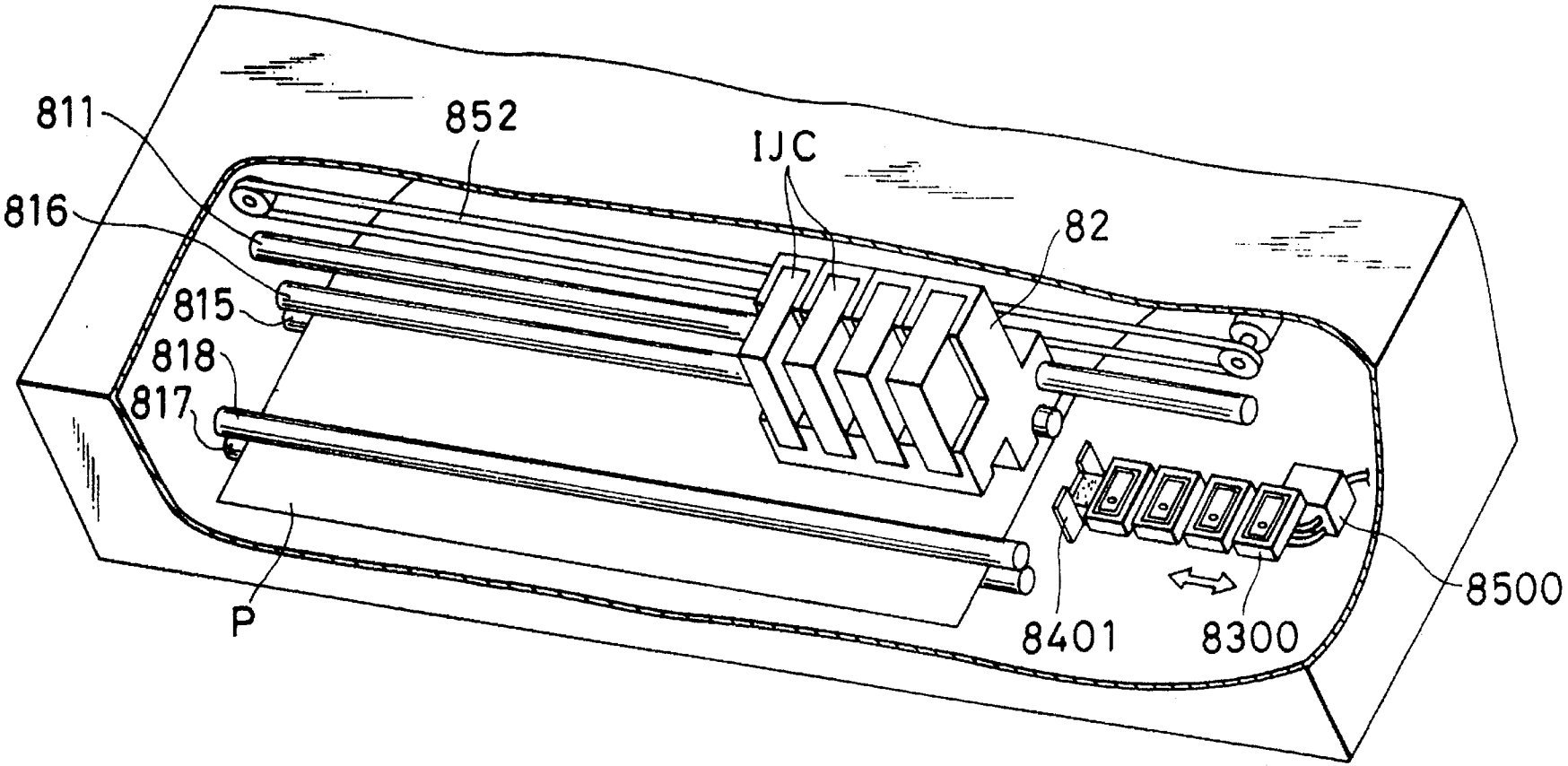
FIG. 13 is a perspective view of an example of an ink jet recording apparatus which can record information with the recording head shown in FIG. 4.

FIG. 4 shows an example of an ink jet cartridge of one embodiment of the present invention which has a recording head and an ink tank within a single unit. The ink jet cartridge of this embodiment has an ink tank unit IT and a recording head unit IJU in a single body, which can be put on and taken off each other. A connector 102 for receiving signals for driving an ink ejection part 101 of the recording head unit IJU and for transmitting signals for reporting the residual amount of ink fluid to a recording apparatus control part is placed at the side face of the ink jet cartridge. Owing to this structure, it will be appreciated that the height of the ink jet cartridge mounted on a carriage to be described later can be taken to be small enough and the thickness of the ink jet cartridge can be taken to be small enough. So far, as shown in FIG. 13 later, it will be appreciated that in case of arranging a plurality of ink jet cartridges in one dimensional array, the carriage assembly can be taken to be small.

In installing the ink jet cartridge in the carriage, the ink jet cartridge can be put on the carriage by carrying the ink jet cartridge with its handle 201 formed at the ink tank unit IT so that the ink ejection part 101 can face downward. The handle 201 is linked to a lever formed at the carriage to be described later which is used when installing the ink jet cartridge into the carriage. When installing the ink jet cartridge into the carriage, the head unit IJU can be positioned by way of a pin formed at the carriage being linked with a pin catcher part 103 formed at the head unit IJU.

In the ink jet cartridge of this embodiment, an absorber 104 used for cleaning a member wiping the surface of the ink ejection part 101 is placed beside the ink ejection part 101. In addition, an air duct port 203 used for introducing air as ink fluid consumption proceeds is placed almost at the center of the ink tank unit IT.

Figure 5:
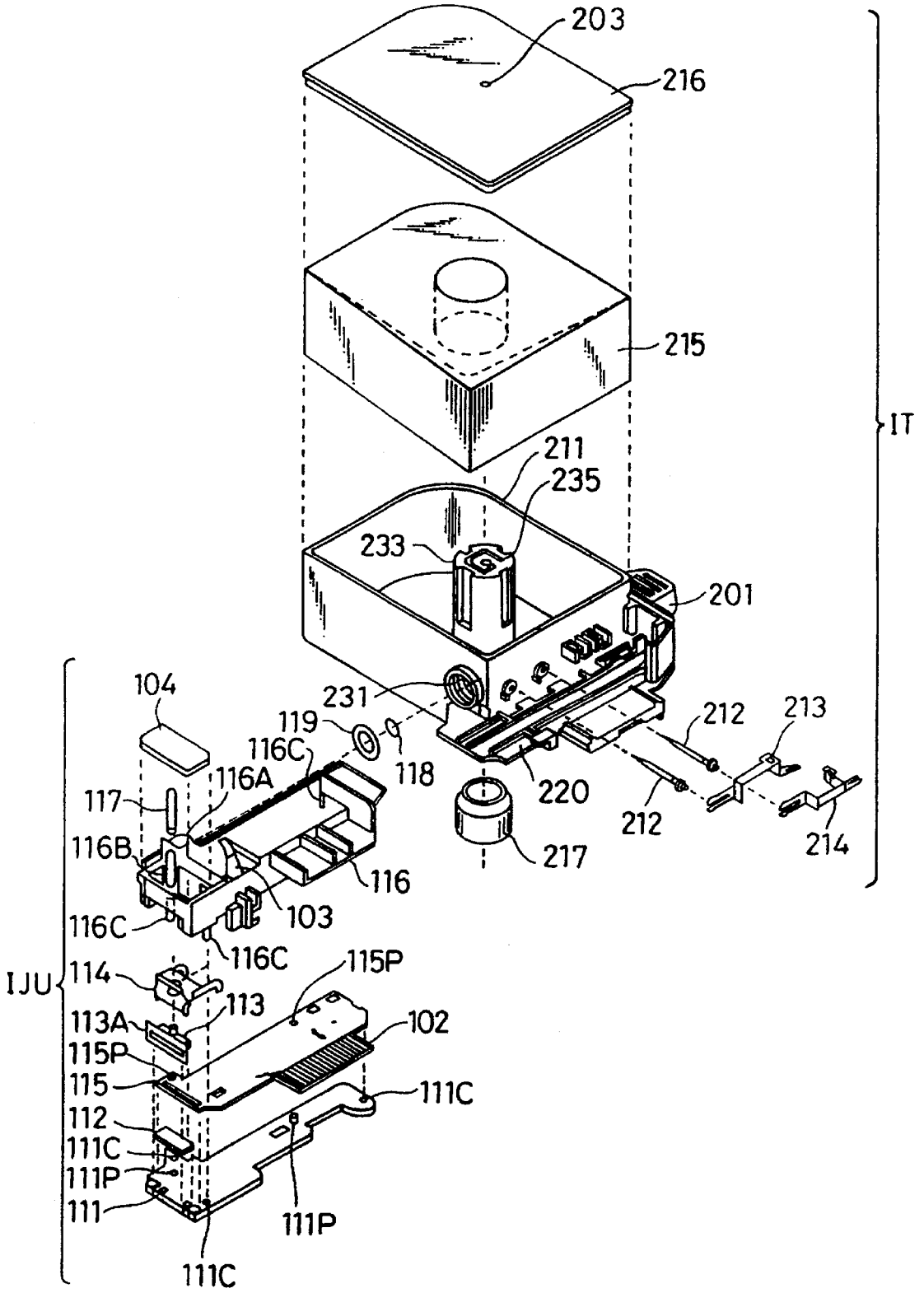
FIG. 5 is an exploded perspective view of the recording head shown in FIG. 4.

FIG. 5 is an exploded perspective view of the ink jet cartridge shown in FIG. 4. The ink jet cartridge is composed of the recording head unit IJU and the ink tank unit IT. In the followings, the detailed structure of these units IJU and IT is described.

Recording Head Unit IJU:

Almost all the component parts of the recording head unit IJU are assembled on a base plate 111 made of A1. On the base plate 111, a substrate 112 on which formed are electronic devices generating thermal energy used for ejecting ink and a print circuit board (PCB) 115 containing electric circuitry for supplying electric power to these devices are mounted, and the substrate 112 and the PCB 115 are connected to each other through wire bonding wirings. On the substrate, installed are electro-thermal conversion elements generating thermal energy used for inducing film boiling in ink fluid in response to electric power supply to the elements. In the following description, the substrate 112 is designated a heater board.

The above mentioned connector 102 is a part of PCB 115 through which driving signals from a control circuit not shown in FIG. 5 are received and driving signals are further transmitted to the heater board 112 through PCB 115. In this embodiment, PCB 115 is formed as a two-sides circuit board on which mounted are condenser (not shown) and IC (not shown) made as a ROM device which contains data generic to the recording head such as adequate driving conditions for electro-thermal conversion elements, ID numbers, ink color attributes and supplementary data for driving conditions such as head shading (HS).

On the heater board 112, disposed is an upper plate 113 having a concave part forming a common fluid reservoir storing temporarily ink fluid supplied from ink tank unit IT, and a plurality of fluid paths connecting the common fluid reservoir and ink ejection orifices perspectively. In addition, an orifice plate 113A at which an orifices are formed is integrally formed with the upper plate 113. A component 114 is a leaf spring for pressing tightly the upper plate 113 against the heater board 112 so that an ink ejection part 101 can be formed.

A component 116 is a head unit cover which is formed in a mold containing an ink fluid supply tube part 116A entering into the ink tank unit IT, an ink fluid channel 116B between the ink fluid supply tube part 116A and an ink fluid leading tube part at the upper plate, three pins 116C for fixing the head unit cover on the base plate 111, a pin coupling part 103, a mounting part of an absorber 104 and the line. As for the ink fluid channel 116B, an ink fluid route cover 117 is placed. A filter 118 for removing small-sized air bubbles and dusts is placed at the top of the ink fluid supply tube part 116A and an O ring 119 is also placed in order to prevent ink fluid leakage from connecting portions of the above mentioned components.

In fabricating the above mentioned head unit, a protruding pin 111P formed on the base plate is positioned by being inserted into a penetration hole 115P formed in PCB 115 and both of the protruding pin 111P and the penetration hole 115P are fixed with bonding and so on. In fixing the protruding pin 111P and the penetration hole 115P, precise positioning is not required. This is because fixing of the heater board 112 in responsive to the base plate 111 which requires high precision can be done independently with respect to PCB 115.

Next, the heater board 112 is fixed with higher precision on the base plate 111 and is connected electrically to PCB 115. And the upper plate 113 and the spring 114 are placed with adequate bonding and sealing, and three protruding pins 116C are fixed by being inserted through the hole 111C on the base plate 111. Finally, the head unit is completed by heating and pressing pins 116C.

Ink Tank Unit:

In FIG. 5, a component 211 is an ink fluid reservoir forming a body of the ink tank unit, a component 215 is an ink fluid absorber, a component 216 is an ink tank cover, a component 212 is an electrode pin for detecting the amount of ink fluid in the ink fluid reservoir and components 213 and 214 are contacting members in responsive to the electrode pin 212.

The ink fluid reservoir 211 has a member 220 used for mounting the pin 212, the contacting members 213 and 214, and used for mounting the above mentioned head unit IJU, a supply port 231 for accepting the ink supply tube part 116A, and a lever 201, as well as a hollow cylinder part 233 standing almost at the center of the bottom of the ink fluid reservoir as shown in FIG. 5. This ink fluid reservoir 211 can be formed by molding synthetic materials in a single body.

The bottom side of the hollow cylinder 233 is opened in supplying ink fluid into the ink fluid reservoir 211 and after the ink fluid reservoir 211 is filled with ink fluid, the bottom side of the hollow cylinder 233 is closed with a cap 217 shown in FIG. 5. The inside space of the hollow cylinder 233 is used as a buffer part for preventing ink fluid leakage due to vibration and movement applied to the ink tank reservoir 211. And furthermore, as the spiral channel 235 makes the air route to the air duct port 203 longer, it will be appreciated that ink fluid leakage can be effectively prevented.

Figure 6:
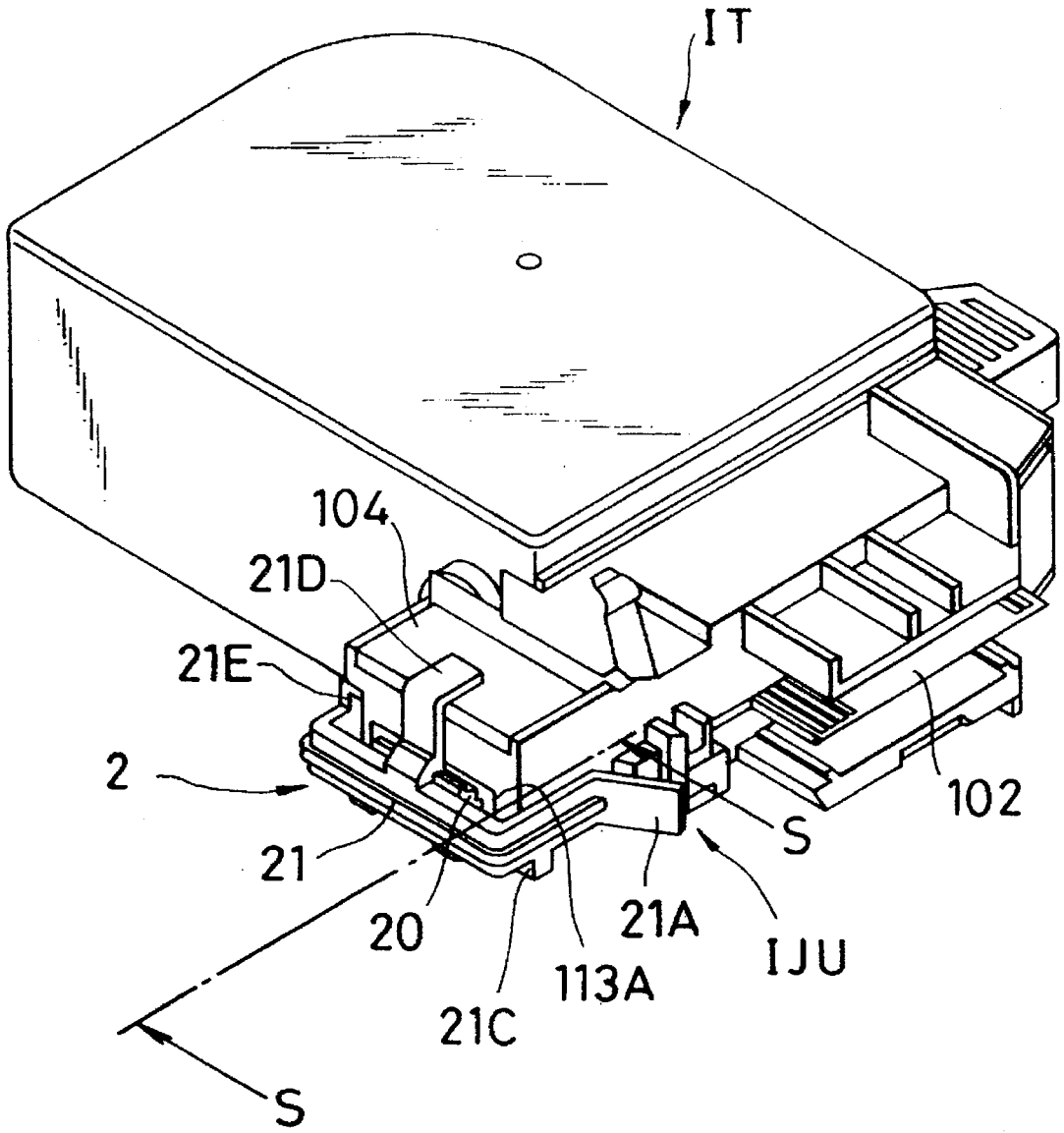
FIG. 6 is a perspective view showing a recording head shown in FIG. 4 which is capped with a cap of an embodiment of the present invention.
Figure 7:
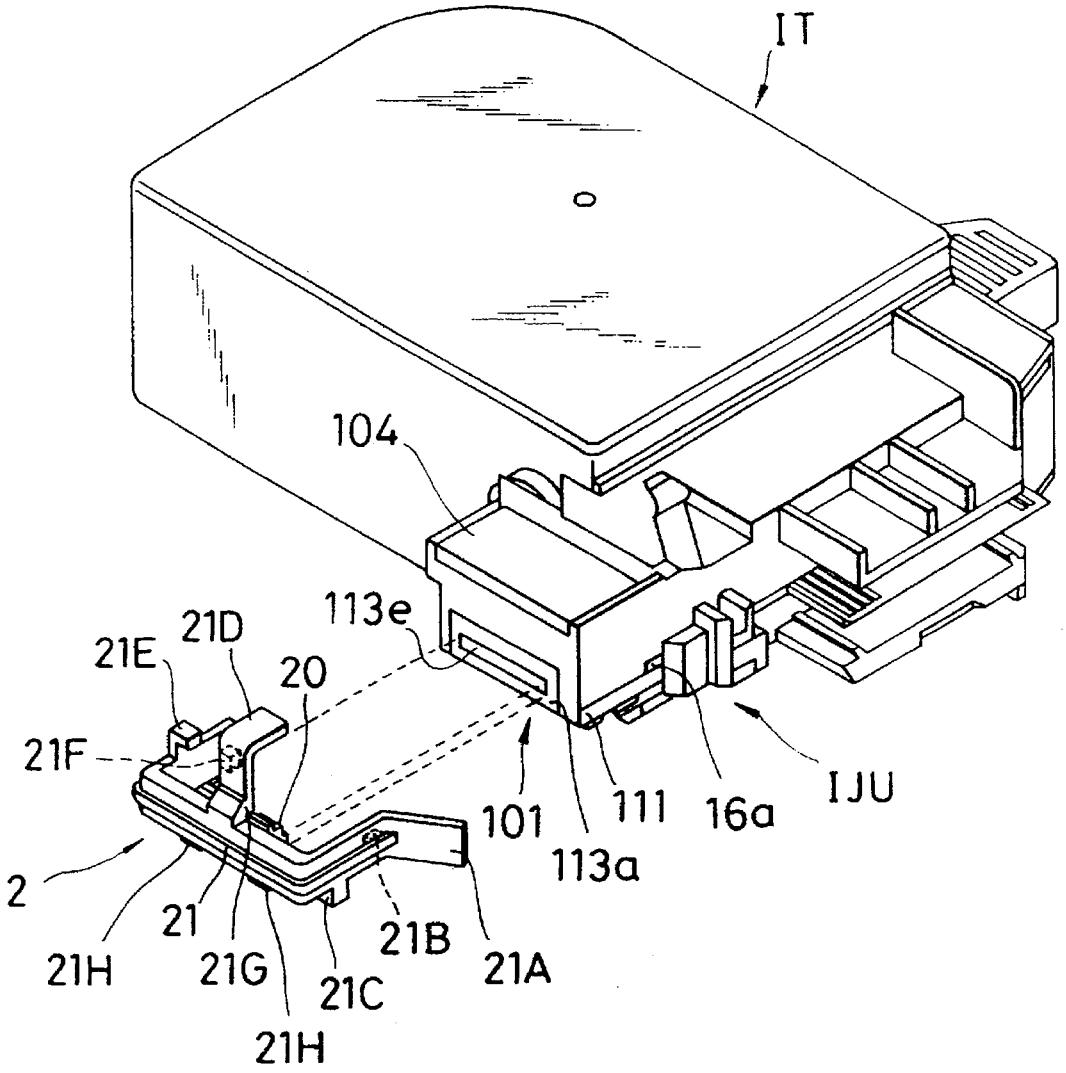
FIG. 7 is a perspective view showing a recording head shown in FIG. 4 from which the cap is removed.

FIGS. 6 and 7 are perspective views of an ink jet cartridge shown in FIGS. 4 and 5 with a cap of one embodiment of the present invention; FIG. 6 shows the case that the cap is installed, and FIG. 7 shows the case that the cap is removed.

As shown in FIGS. 6 and 7, the cap 2 is made of synthetic materials and the cap 2 is composed of a holder 21 which is shaped in an open square and has an L-shaped arm at the center of the holder 21 and of a contacting member 20 supported by the holder 21. When the cap 2 is installed on the ink fluid ejection part 101, the top part 21D of the L-shaped arm standing from the center of the cap 2 touches the upper face of the ink absorber 104 placed above the ink fluid ejection part 101. And a square-shaped protruding part 21C formed below the one side of the holder beam extended horizontally touches a part of the base plate 111. So far, the cap 2 can be fixed in the vertical direction shown in FIG. 6. In FIG. 7, small protruding parts 21B and 21F formed at respective side of the holder beam extended horizontally are caught by the channel 16*a* and 16*b*, not shown in FIG. 6, both channel 16*a* and another channel not shown formed at both sides of the ink fluid ejection part 101. And furthermore, an L-shaped protruding part 21E extended from one side of the holder beam extended horizontally where the small protruding part 21F is formed is locked at the corner formed beside the ink fluid ejection part 101. So far the cap 2 can be fixed in the horizontal direction shown in FIG. 6. As a result, it will be appreciated that the cap 2 is protected from being dropped or displaced while transporting the ink jet cartridge.

And furthermore, the relationship between the distance between the protruding parts 21B and 21F and the contacting member 20 and the distance between the orifice disposed face 113*e* to which the contacting member 20 contacts and the channels 16*a* and the channel not shown are determined adequately. With this determination of distance relationship, when the protruding parts 21B and 21F are caught by the channels 16*a* and 16*b*, the orifice disposed face 113*e* is pressed by the contacting member 20 as described later.

In the case that the cap 2 is removed from the ink fluid ejection part 101, the one holder beam of the holder 21 is displaced outside by pulling a handle portion 21A. The handle portion 21A may be bent at an angle of 45°–90° relative to the holder beam. So far, the cap 2 can be easily removed even if the cap 2 is securely fixed to the ink fluid ejection part 101. In addition, since the cap 2 can be removed from the ink fluid ejection part 101 only when the handle portion 21A is pulled, the cap can be protected from being dripped by a shock at transportation.

Figure 8:
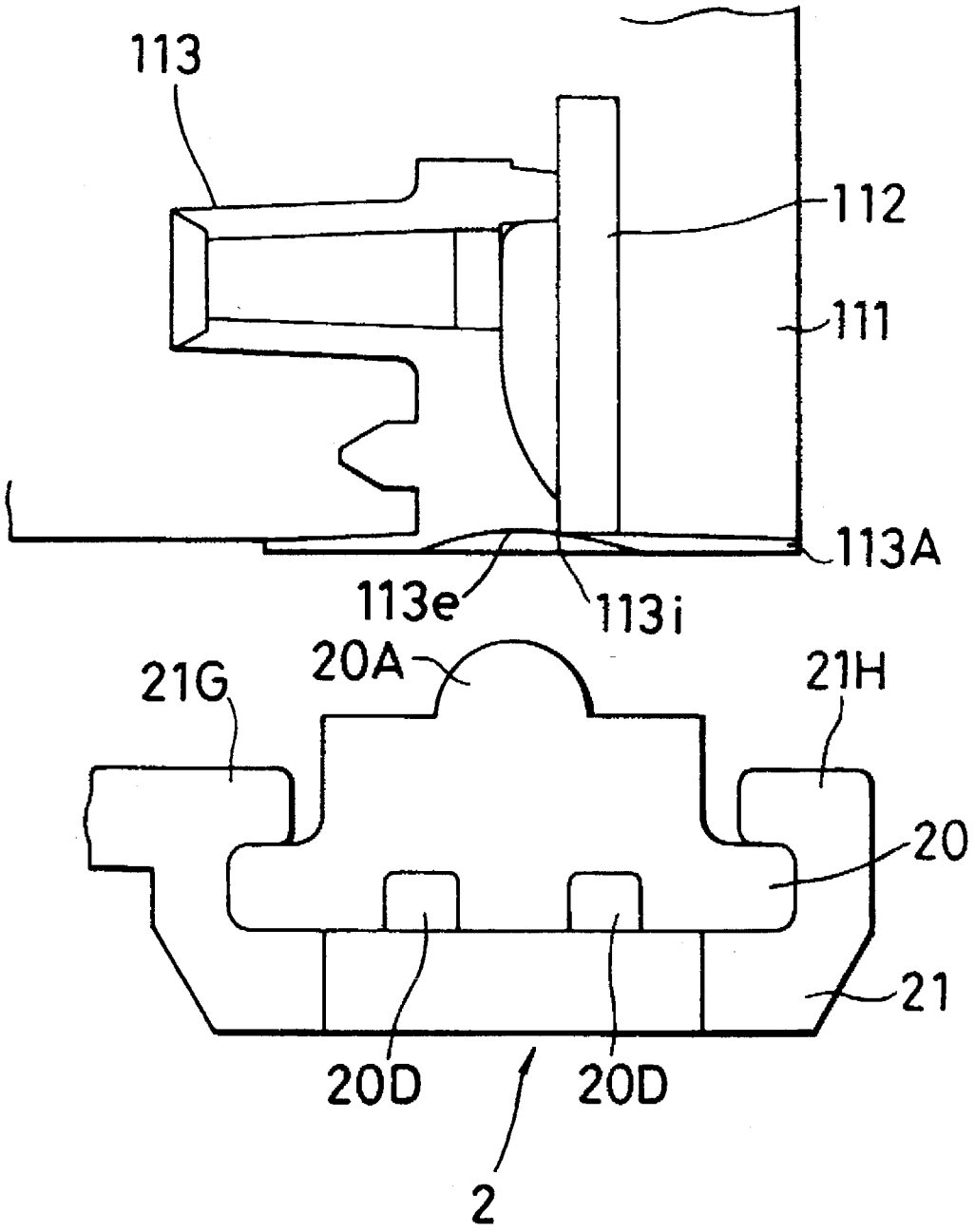
FIG. 8 is a detailed cross-sectional view of a recording head from which the cap shown in FIG. 4 is removed.
Figure 9:
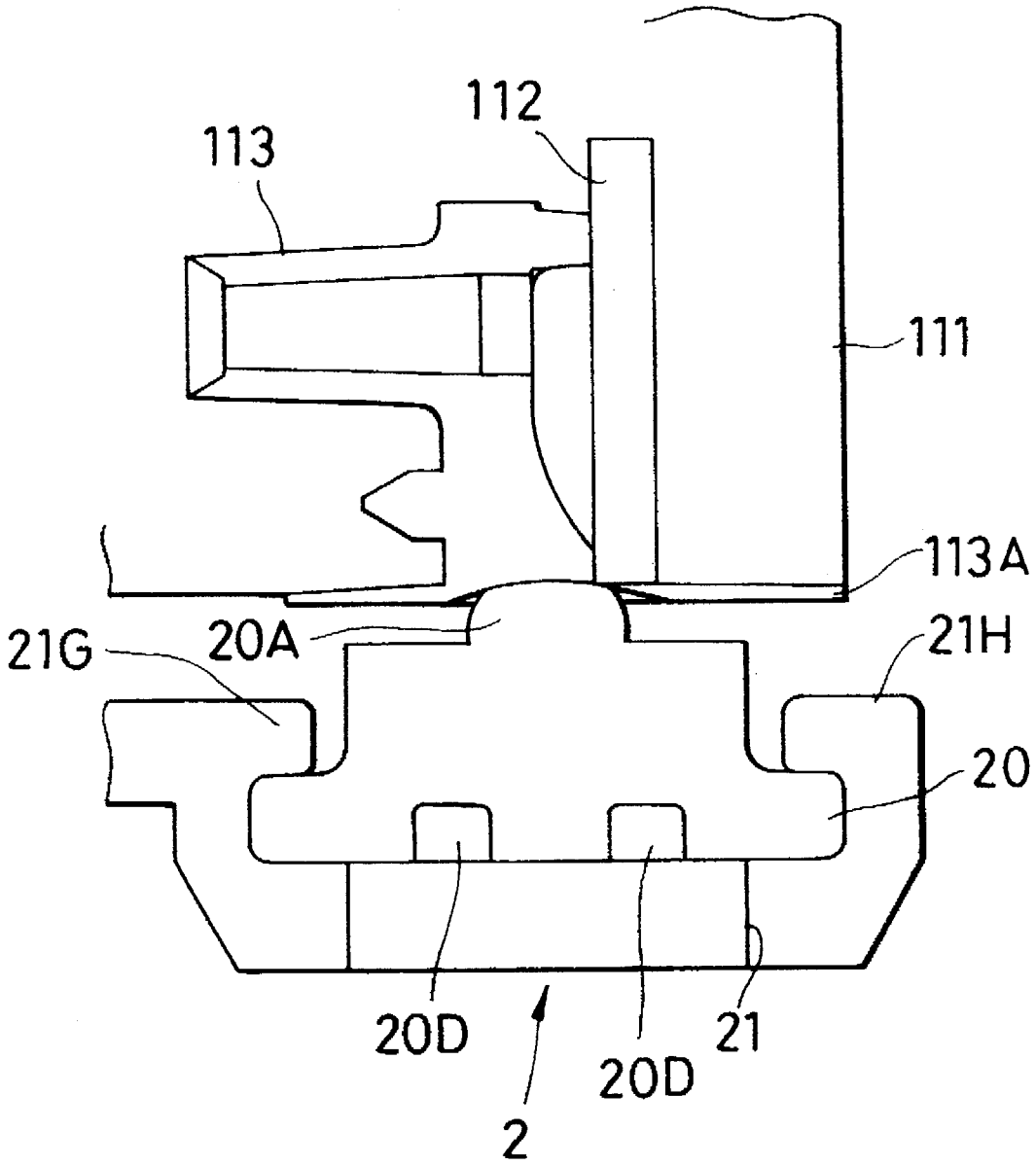
FIG. 9 is a detailed cross-sectional view of a recording head capped with the cap shown in FIG. 4.

FIG. 8 shows a case that the contacting member 20 of the cap 2 is put away from the orifice disposed face 113*e*. FIG. 9 shows a case that the contacting member 20 of the cap 2 touches the orifice disposed face 113*e*. FIGS. 8 and 9 are magnified cross-sectional views of the cap 2 and the major part of the recording head unit, each view projected in the direction of the arrow S shown in FIG. 6.

As shown in FIGS. 8 and 9, the contacting member 20 is supported by a latch 21G formed at the center side of the holder 21 and by two latches 21H formed at the other side of the holder 21. Materials used for the contacting member 20 are supposed to be elastic materials including rubbers such as nytril rubber, silicon rubber, fluorine rubber and urethane rubber, or thermal-plastic elastomers, the hardness of which is preferred to be less than or equal to 80° in JIS A and to maintain its own shape and not to be adhesive. Furthermore, the materials for the member 20 is preferred to be ink-resisting.

As shown in FIGS. 8 and 9, the cross-sectional shape of the orifice disposed face 113*e* is unsymmetrical concave arc and this concave shape is extended upward and downward in a designated length in the vertical direction relative to the figure plane. The half-moon-shaped contacting part 20A of the contacting member 20 is extended upward and downward in an identical length to that of the orifice disposed face 113*e* in the vertical direction relative to the figure plane.

The concave shape of the orifice disposed face 113*e* is determined in the following reasons. In case that an orifice is formed on the orifice plate 113A, the orifice 113*i* is so fabricated by applying laser beams. In order to fabricate the orifice 113*i* efficiently by laser beams, the orifice disposed face 113*e* and its axis are tilted in relative to the fluid path. In order that the distance between the orifice disposed face 113*e* so tilted and the recording medium is selected to be an adequate value and that the pressing force developed by the pressing spring 114 (shown in FIG. 5) is effectively utilized, an end part of the tilted orifice disposed face 113*e* far from the recording medium, which is shown in the left side of FIG. 8, is displaced forward, and the other end part of the tilted orifice disposed face 113*e* near the recording medium, which is shown in the right side of FIG. 8, is displaced backward. As a result, as shown in FIG. 8, the shape of the orifice disposed face 113*e* is a half-moon-shaped convex.

The unsymmetrical concave shape of the cross-section of the orifice disposed face 113*e* is determined by considering the direction in which the before mentioned blade wipes the orifice disposed face 113*e* and by considering the relative positions of the absorber 104 for cleaning this blade and the orifice disposed face 113*e*. So determined the cross-sectional shape of the orifice disposed face 113*e*, the efficiency of wiping the orifice disposed face 113*e* by the blade is attained to be high. The position of the contacting part 20A when contacting the orifice disposed face 113*e* is selected so that the top of the circle of the half-moon-shaped contacting part 20A may goes to the deepest point of the orifice disposed face 113*e*. By means that the contacting part 20A contacts the deepest point of the orifice disposed face 113*e*, it will be appreciated that a pressing force can be prevented from being applied directly to a part where the orifice 113*i* which does not have an enough structural rigidity is placed. And furthermore, the pressing force is applied to the deepest point of the orifice disposed face 113*e*, a uniform pressing force can be established on the whole face of the orifice disposed face 113*e*. In the orifice disposed face 113*e*, the orifice 113*i* is shifted from this deepest point of the arc. Owing to this configuration, the efficiency of wiping the orifice disposed face 113*e* by the blade is attained to be high, too. When the contacting part 20A contacts the orifice disposed face 113*e*, the orifice 113*i* can be sealed tightly by means that the contacting part 20A is deformed by the force developed by the channels 16*a* and 16*b* on the side face of the ejection part 101 catching the above mentioned protruding parts 21B and 21F of the holder 21. That is, as the contacting part 20A has a half-moon-shaped cross-section, the press force can be developed almost uniformly against the orifice disposed face 113*e*. And hence, the contacting part 20A can be deformed almost uniformly in the concave shape in responsive to the concave shape of the orifice disposed face 113*e*. So far, the contacting part 20A can seal tightly the orifice 113*i*.

A preferred shape of the contacting part 20A is also supposed to be a half-oval as well as a half-moon shape. The shape of the contacting part 20A is not limited to these shapes but may be selected to be optimal one in relative to the shape of the orifice disposed face 113*e*. In case of using a half-moon or half-oval shaped member for the contacting part 20A, its curvature radius is a little smaller than that of the concave shape part of the orifice disposed face. In this embodiment, the amount of deformation of the contacting part 20A is about 0.5 mm, which is within a favorable range between 0.3 mm and 0.9 mm.

As described above, in this embodiment, as the orifice 113*i* and its neighboring area can be sealed tightly with the contacting part composed of elastic and deformable materials, in sealing the orifice 113*i*, a uniform press force can be developed and the shape of the contacting part can be deformed to be an identical shape to the shape of the orifice disposed face 113*e*. As a result, the orifice 113*i* and its neighboring area can be sealed tightly. The channels 20D which are formed in the contacting member 20 and which extend along the array of the orifices 113*i* are so designed that the elastic deformation of the contacting member 20 may be adequate and that deformation of the contacting member 20 in its installation and easiness of installation may be considered.

Though in the above mentioned embodiment, the shape of the orifice disposed face sealed tightly by the cap of the present invention is selected to be an unsymmetrical concave, it will be appreciated that, in case of using a flat-shaped orifice disposed face 113*e*, an effective sealing of the orifice disposed face can be attained. In this case, desirable and tight sealing of the orifice disposed face 113*e* or its neighboring area can be established by means that the top of the contacting part 20A is positioned to a designated position of the orifice 113*i*.

Figure 10:
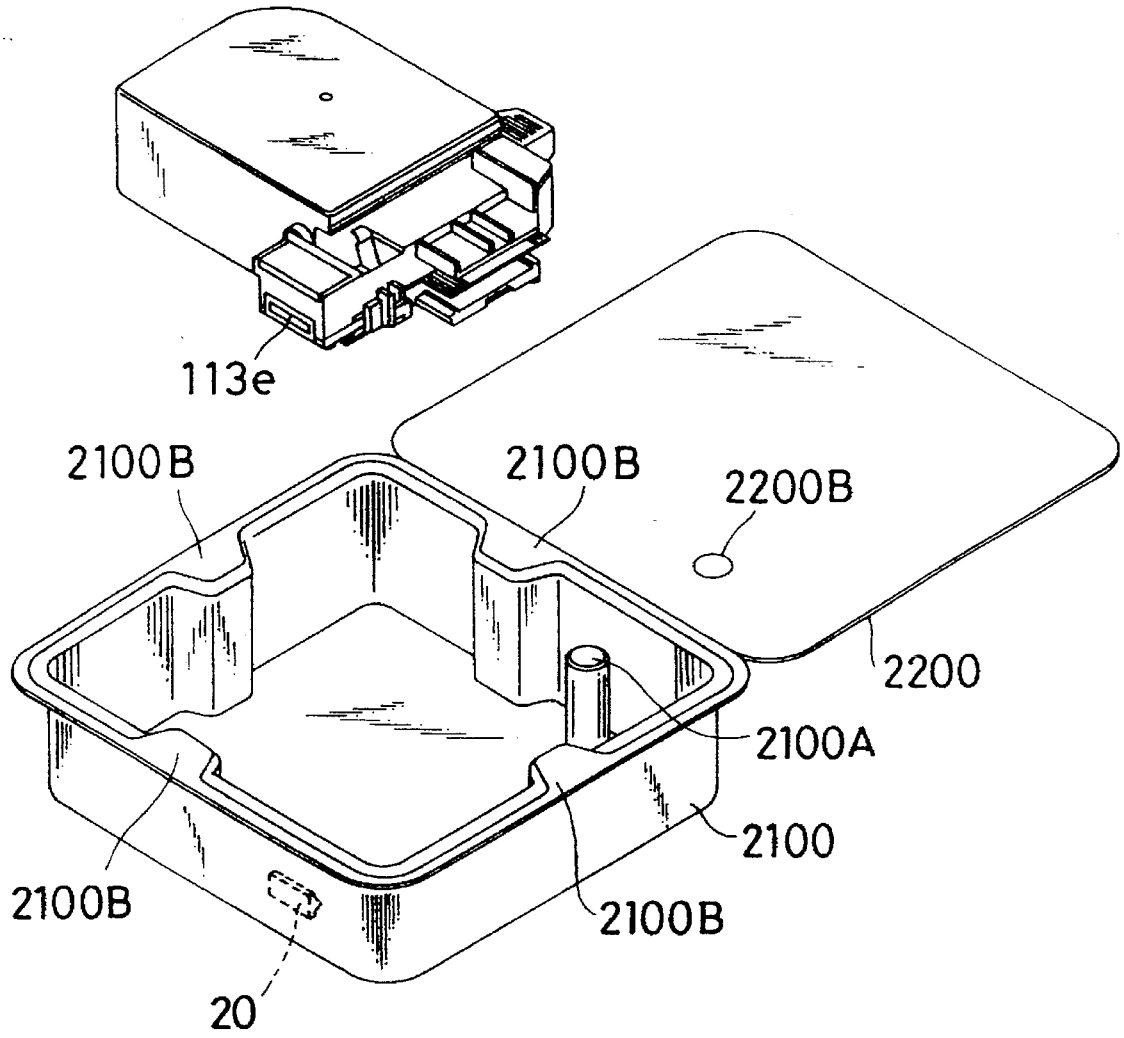
FIG. 10 is a perspective view of an example of a recording head container of the other embodiment of the present invention which is also used as a cap for the recording head.
Figure 11:
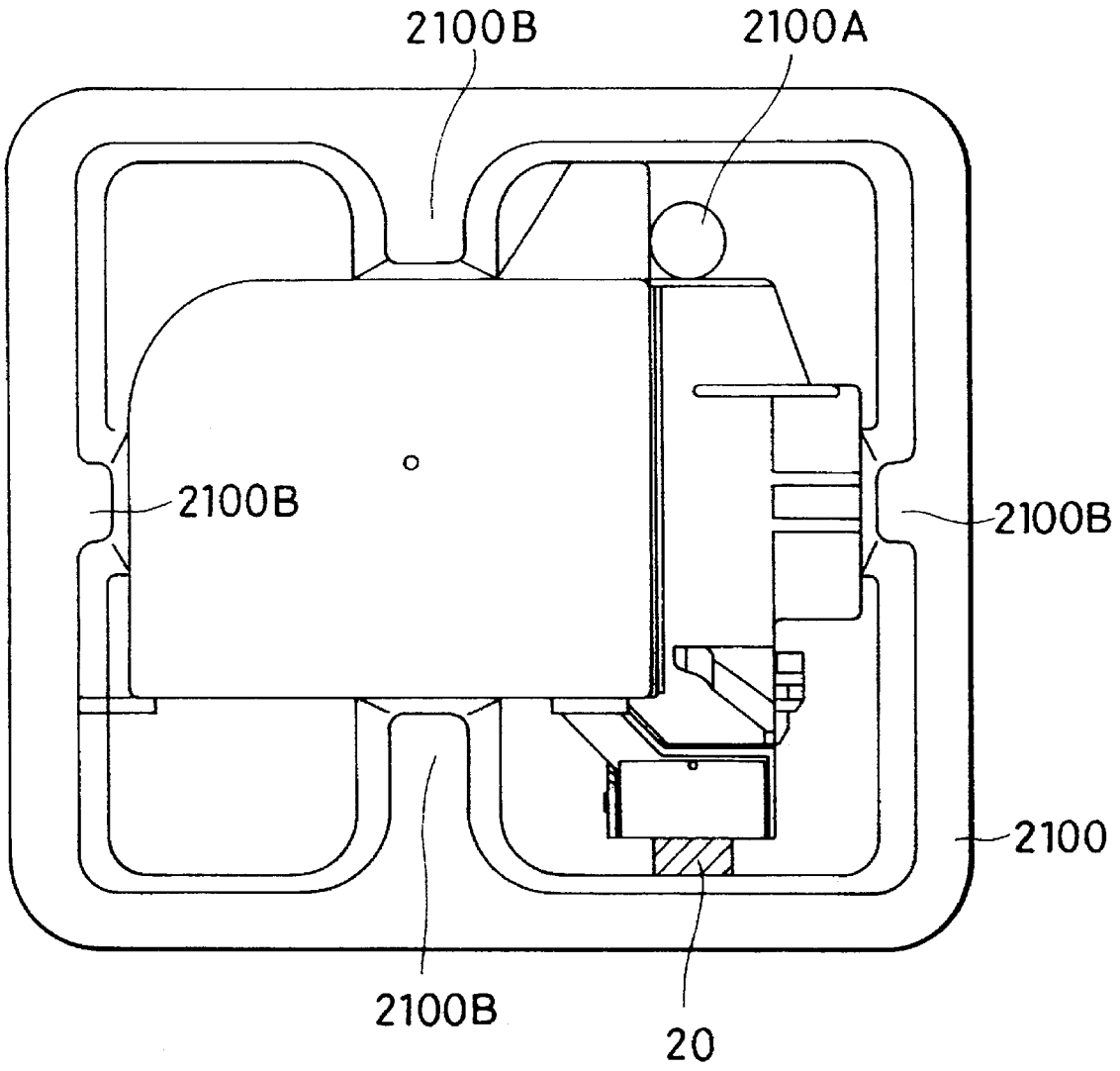
FIG. 11 is a plan view of the recording head container shown in FIG. 10 which contains a recording head.

FIGS. 10 and 11 are a perspective view and a plan view showing a container storing the above mentioned ink jet cartridge as shown in FIGS. 4 and 5, respectively.

The ink jet cartridge is transported and stored within the container. The container of this embodiment is also used as a holder of the contacting member described in the above embodiment. That is, as shown in FIGS. 10 and 11, the contacting member 20, which is formed similarly to that of the above mentioned embodiment shown in FIGS. 8 and 9, is mounted within a part of the container 2100. When storing the ink jet cartridge into the container 2100, the orifice disposed face 113*e* contacts the contacting member 20 and tight sealing of the orifice is established.

Within the container 2100, a cylindrical-shaped protruding part 2100A is formed, which is used as a positioning member when the ink jet cartridge is installed and stored in the container 2100. In addition, this cylindrical-shaped protruding part 2100A functions in such manner that the orifice disposed face 113*e* of the ink jet cartridge installed in the container 2100 pushes the contacting member 20 because the distance between the contacting member 20 and the cylindrical-shaped protruding part 2100A is less than the length of the corresponding portion of the cartridge. So far, in installing the ink jet cartridge into the container 2100, tight sealing of the orifice disposed face 113*e* can be established.

The protruding part 2100A is linked with the hole 2200B formed in the cover 2200 of the container when the cover 2200 is closed so that the cover 2200 is fixed with the container 2100. In FIG. 10, components 2100B are convex portions for positioning the ink jet cartridge installed within the container 2100.

Figure 12:
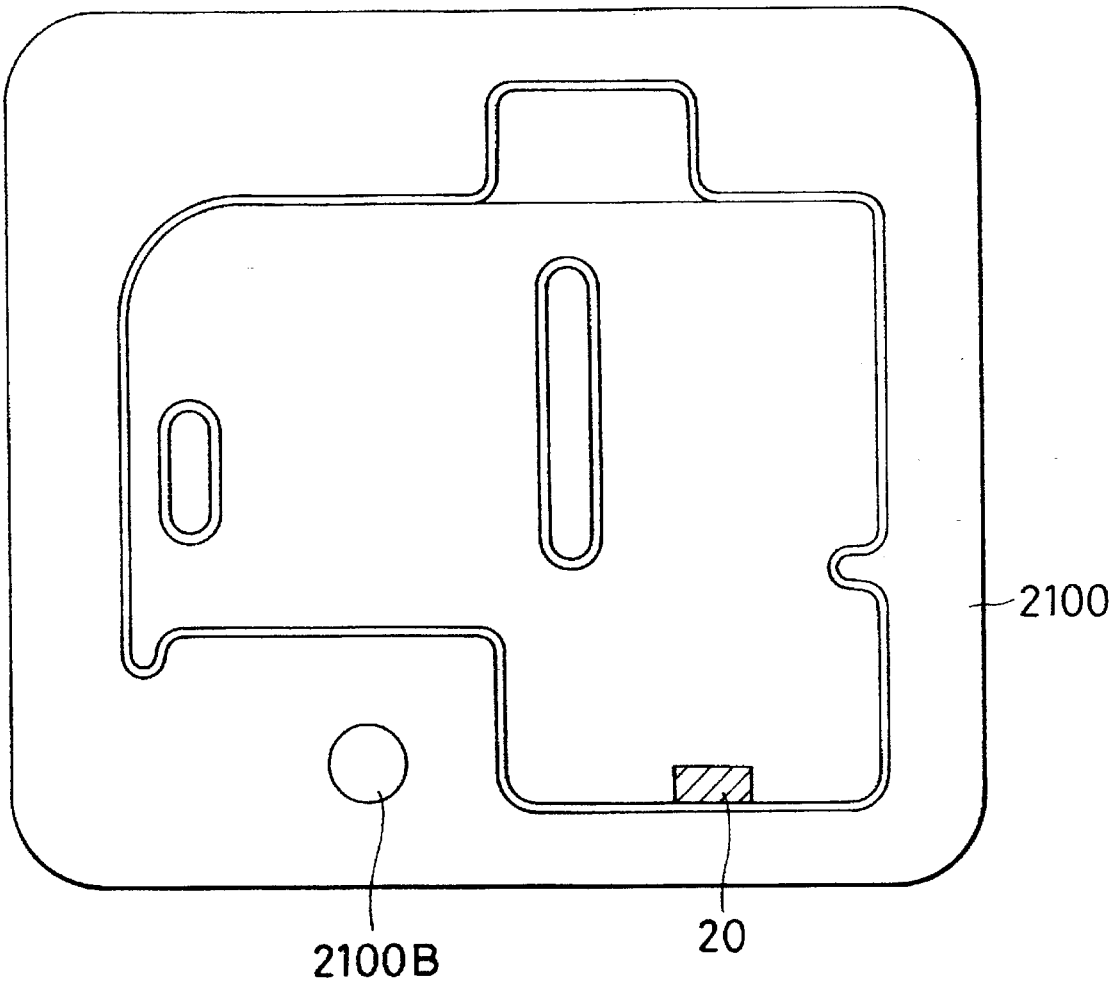
FIG. 12 is a plan view of the other example of a recording head container.

FIG. 12 is a plan view of the other embodiment of the above mentioned container. As shown in FIG. 12, the container 2100 has an inner structure adjusted for the shape of the ink jet cartridge. In this container 2100, the contacting member 20 for sealing the orifice disposed face is also formed. A component 2100B is a hole for fixing the cover, and a cylindrical-shaped protruding part to be linked with the hole 2100B is formed in the container cover, not shown in FIG. 11.

Shapes of the contacting member and the orifice disposed face may not be limited to those described in the above embodiments. That is, the contacting member of the present invention can be elastically deformed in responsive to the shape of the orifice disposed face so that tight sealing of the orifice disposed face may be established.

FIG. 13 is a perspective view of an ink jet recording apparatus using the above mentioned ink jet cartridge. The ink jet recording apparatus of FIG. 13 is a full-color serial type printer which have exchangeable ink tanks, each of which corresponds to ink colors of black (Bk), cyan (C), magenta (M) and yellow (Y). As an example, the ink jet head of this embodiment has 128 pieces of orifices and gives a recording density of 400 dots per inch with a driving frequency 4 KHz for ejecting ink fluid periodically.

In FIG. 13, components IJC are four ink jet cartridges, each cartridge corresponding to each individual ink color, yellow, magenta, cyan or black. The ink jet cartridge is formed in a unit containing a recording head unit, and an ink tank unit storing ink fluid to be supplied to the recording head unit. The ink jet cartridge IJC is mounted on the carriage so that the ink jet cartridge IJC may be removable for the carriage with a structure not shown in FIG. 13. The carriage 82 is supported on the guide rail 811 so that the carriage 82 can move along the guide rail 811, and the carriage 82 is connected to a part of a drive belt 852 driven by a main scan motor not shown in FIG. 13. Owing to this structure, the ink jet cartridge IJC can move along the guide rail 811. Components 815, 816, 817 and 818 are transport rollers placed to be parallel to the guide rail 811; transport rollers 815 and 816 are placed behind the guide rail 811, and transport rollers 817 and 818 are placed in front of the guide rail 811. Transport rollers 815, 816, 817 and 818 are driven by a sub scan motor in order to supply a recording medium P. The recording medium P is supplied forward to the orifice disposed face of the ink jet cartridge IJC so as to establish a recording face on the recording medium P.

An ejection recovery unit is placed in relative to the region in which the ink jet cartridge IJC can move and the recording of information onto the recording medium is not given. In the recovery unit, a component 8300 is a cap unit corresponding to each recording head of the ink jet cartridge IJC. In responsive to the movement of the carriage 82, the cap unit 8300 can move in the horizontal direction in FIG. 13, and move in relative to the movable region of the ink jet cartridge IJC. When the carriage 82 is located at the home position, the cap unit 8300 moves forward to the recording head and contacts the recording head, and finally covers the orifice disposed face. In the recovery unit, a component 8401 is a blade used as a wiping member.

In addition, a component 8500 is a pump unit evacuating ink fluid from the orifice of the recording head and its neighboring area through the cap unit 8300.

In the above described embodiment, disclosed is a cap structure where a seal tape is not used between the contacting member of the cap and the orifice disposed face. It will be appreciated that the case that a seal tape is used in the cap of the present invention may give the similar advantage to that of the present invention.

Figure 14:
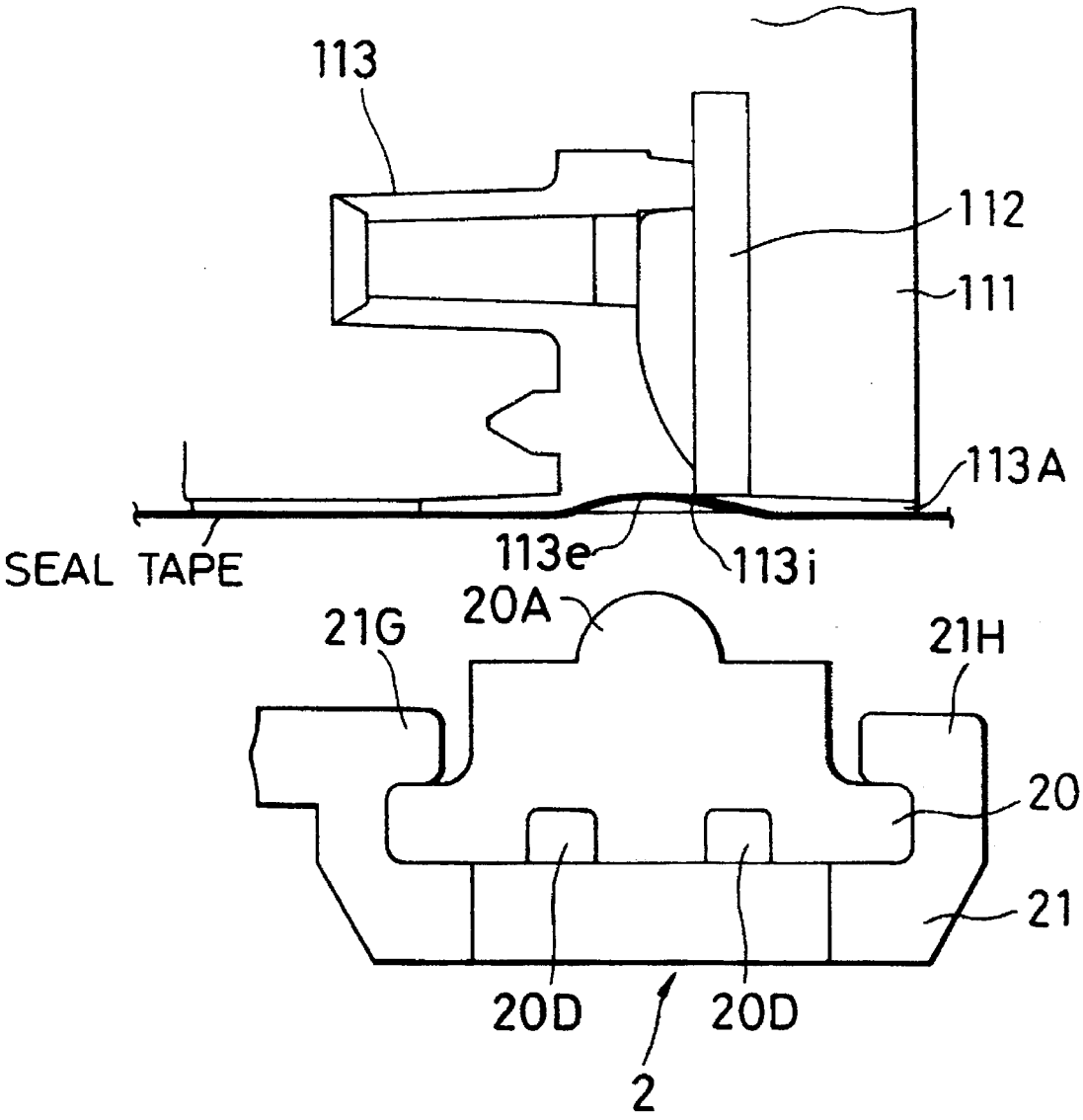
FIG. 14 is a cross-sectional view of a cap further with a seal in one embodiment of the present invention.
Figure 15:
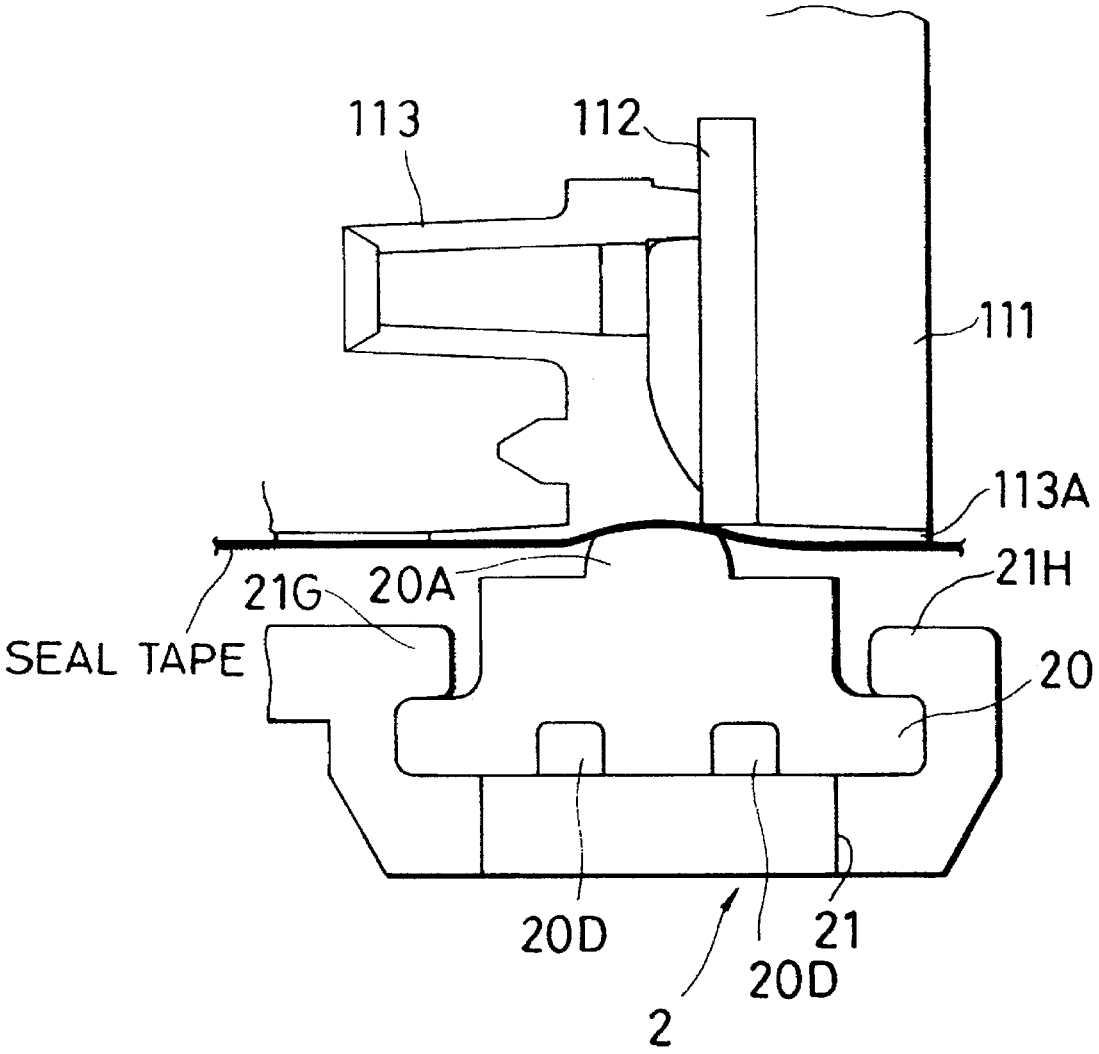
FIG. 15 is a cross-sectional view of a recording head with the cap shown in FIG. 14.

FIGS. 14 and 15 shows a case that a seal tape is used in a cap structure shown in FIGS. 8 and 9. As shown in FIG. 14, a seal tape 20*c* is shaped and bonded on the orifice disposed face 113*e* prior to installing cap 2 in the recording head. And furthermore, as shown in FIG. 15, when the cap 2 is installed in the recording head, the pressing member 20A presses the seal 20*c* against the orifice disposed face. So far, in the cap structure of the present invention, the pressing force developed by the cap can be applied effectively and uniformly onto the seal 20*c*, and hence, the sealing of the orifice 113*i* by the seal 20*c* can be established effectively.

The present invention achieves distinct effect when applied to a recording head or a recording apparatus which has means for generating thermal energy such as electrothermal transducers or laser light, and which causes changes in the ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the thermoelectric transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, as an output device of a facsimile apparatus having a transmission and receiving function, and as an output device of an optical disc apparatus for recording and/or reproducing information into and/or from an optical disc. These apparatus requires means for outputting processed information in the form of hard copy.

Figure 16:
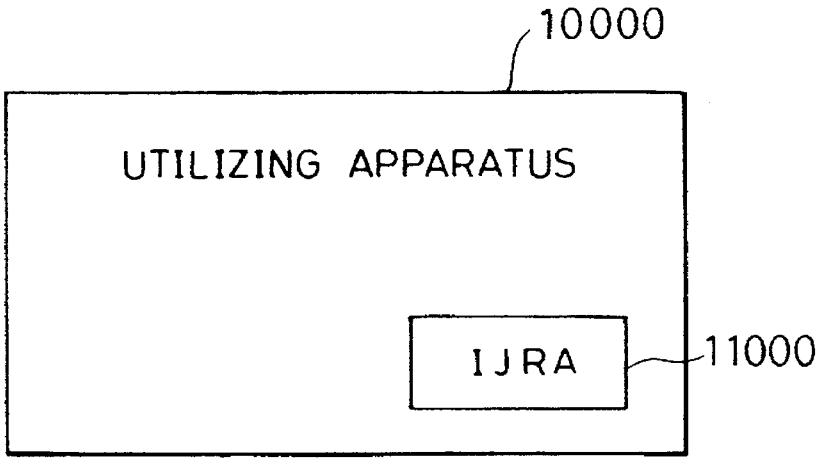
FIG. 16 is a schematic block diagram showing an example of an apparatus where an ink jet recording apparatus of the present invention is mounted.

FIG. 16 schematically illustrates one embodiment of a utilizing apparatus in accordance with the present invention to which the ink jet recording system shown in FIG. 13 is equipped as an output means for outputting processed information.

In FIG. 16, reference numeral 10000 schematically denotes a utilizing apparatus which can be a work station, a personal or host computer, a word processor, a copying machine, a facsimile machine or an optical disc apparatus. Reference numeral 11000 denotes the ink jet recording apparatus (IJRA) shown in FIG. 13. The ink jet recording apparatus (IJRA) 11000 receives processed information form the utilizing apparatus 10000 and provides a print output as hand copy under the control of the utilizing apparatus 10000.

Figure 17:
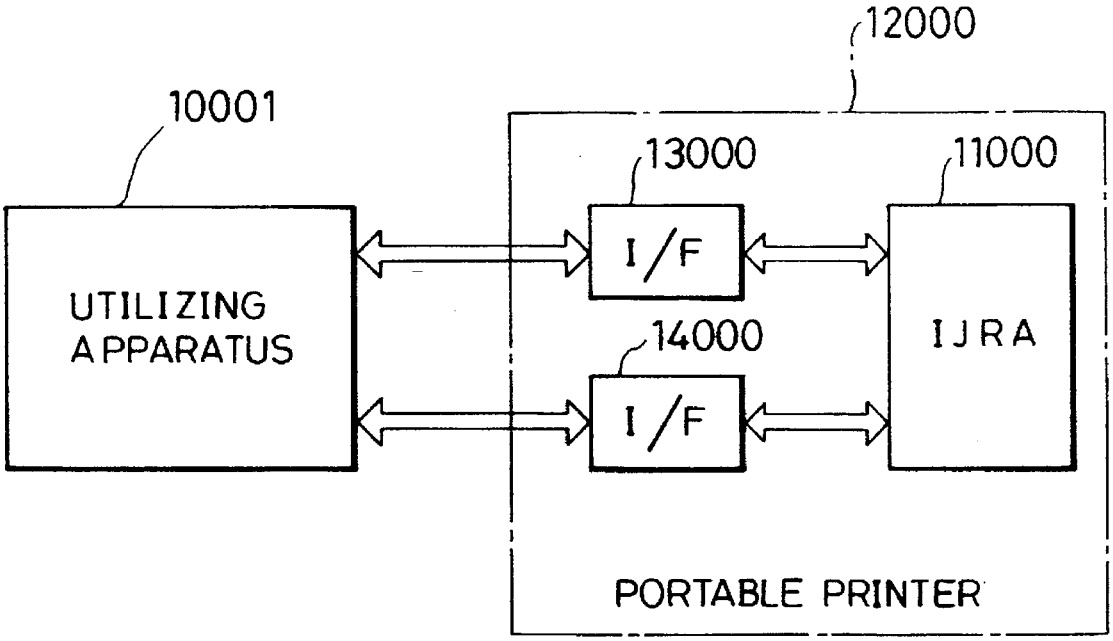
FIG. 17 is a schematic block diagram showing a portable printer using an ink jet recording apparatus of the present invention.

FIG. 17 schematically illustrates another embodiment of a portable printer in accordance with the present invention to which a utilizing apparatus such as a work station, a personal or host computer, a word processor, a copying machine, a facsimile machine or an optical disc apparatus can be coupled.

In FIG. 17, reference numeral 10001 schematically denotes such a utilizing apparatus. Reference numeral 12000 schematically denotes a portable printer having the ink jet recording apparatus (IJRA) 11000 shown in FIG. 13 is incorporated thereinto and interface circuits 13000 and 14000 receiving information processed by the utilizing apparatus 11001 and various controlling data for controlling the ink jet recording apparatus 11000, including hand shake and interruption control from the utilizing apparatus 11001. Such control per se is realized by conventional printer control technology.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A cap which can be installed in an ink jet recording head for sealing a plurality of ink ejection orifices of said ink jet recording head, said plurality of ink ejection orifices being arranged in a line, said cap comprising:

an elastic member having a projecting portion with a strip like shape to press a face of the ink jet recording head at which face said plurality of ink ejection orifices are disposed; and a holder having an engage portion for engaging with the ink jet recording head so as to hold and fix said elastic member so that said projecting portion presses said face, and positioning said projecting portion so that a longitudinal direction of said projecting portion lies along a direction of the line in which said plurality of ink ejection orifices are arranged, wherein when said projecting portion is pressed against said face, said projecting portion elastically deforms following a profile of said face to seal said plurality of ink ejection orifices.

2. A cap as claimed in claim 1, wherein a cross section of said projecting portion is shaped in a curve.

3. A cap as claimed in claim 2, wherein said holder includes a lever for removing said cap from the ink jet recording head, said lever of said cap when installed on the ink jet recording head being disposed at an angle between about 45° and about 90° relative to a direction in which said cap is installed on said ink jet recording head.

4. A cap as claimed in claim 2, wherein said elastic member is composed of a rubber material, said material having a hardness less than or equal to 80° of JIS A.

5. A cap as claimed in claim 1, wherein said elastic member is made of at least one ink-resisting material.

6. A cap as claimed in claim 1, wherein an amount of deformation of said elastic member is within a range of about 0.3 mm to about 0.9 mm.

7. A cap as claimed in claim 1, wherein a cross section of said projecting portion has a convex shape.

8. A cap as claimed in claim 7, wherein said projecting portion engages with said face in a manner that a peak of said convex shape of said projecting portion engages a portion except a portion in which said plurality of ink ejecting orifices are arranged.

9. A container for holding an ink jet recording head which has a plurality of ink ejection orifices arranged in a line, said container comprising:

an elastic member having a projecting portion with a strip like shape to press a face of the ink jet recording head at which face said plurality of ink ejection are disposed; and a case member having an engage portion for engaging with the ink jet recording head so as to hold and fix said elastic member so that said projecting portion presses said face, and positioning said projecting portion so that a longitudinal direction of said projecting portion lies along a direction of the line in which said plurality of ink ejection orifices are arranged, wherein when said projecting portion is pressed against said face, said projecting portion elastically deforms following a profile of said face to seal said plurality of ink ejection orifices.

10. A container as claimed in claim 9, wherein a cross section of said projecting portion is shaped in a curve.

11. A container as claimed in claim 10, wherein said elastic member is composed of a rubber material, said material having a hardness less than or equal to 80° of JIS A.

12. A container as claimed in claim 9, wherein said elastic member is made of at least one ink-resisting material.

13. A container as claimed in claim 9, wherein a cross section of said projecting portion has a convex shape.

14. A container as claimed in claim 13, wherein said projecting portion engages with said face in a manner that a peak of said convex shape of said projecting portion engages a portion except a portion in which said plurality of ink ejecting orifices are arranged.

15. A combination comprising:

an ink jet recording head in which a plurality of ink ejection orifices for ejecting ink are arranged in a line; and a cap which can be installed in the ink jet recording head for sealing said plurality of ink ejection orifices, said cap including:

an elastic member having a projecting portion with a strip like shape to press a face of the ink jet recording head at which face said plurality of ink ejection orifices are disposed; and a holder having an engage portion for engaging with said ink jet recording head so as to hold and fix said elastic member so that said projecting portion presses said face, and positioning said projecting portion so that a longitudinal direction of said projecting portion lies along a direction of the line in which said plurality of ink ejection orifices are arranged, wherein when said projecting portion is pressed against said face, said projecting portion elastically deforms following a profile of said face to seal said plurality of ink ejection orifices.

16. A combination claimed in claim 15, wherein a cross section of said projecting portion is shaped in a curve.

17. A combination as claimed in claim 10, wherein said recording head generates a bubble in ink by means of thermal energy and ejects ink in responsive to generating said bubble.

18. A combination as claimed in claim 15, wherein said face at which said plurality of ink ejection orifices is disposed is shaped in a concave face.

19. A combination as claimed in claim 18, wherein said projecting portion engages with a concave portion of said face.

20. A combination as claimed in claim 15, wherein said elastic member is made of at least one ink-resisting material.

21. A combination as claimed in claim 15, wherein said face on which said plurality of ink ejection orifices are disposed has a concave profile.

22. A combination as claimed in claim 21, wherein said projecting portion engages with a concave portion of said face.

23. A combination as claimed in claim 15, wherein an ink cartridge for holding an ink is attached to said ink jet recording head.

24. A combination as claimed in claim 23, wherein said ink cartridge is filled with the ink.

25. A combination as claimed in claim 15, wherein an elastically deformable part of said elastic member is a part adapted to prevent the ink near said plurality of ink ejection orifices from becoming more viscous.

26. A combination as claimed in claim 15, wherein a cross section of said projecting portion has a convex shape.

27. A combination as claimed in claim 26, wherein said projecting portion engages with said face in a manner that a peak of said convex shape of said projecting portion engages a portion except a portion in which said plurality of ink ejecting orifices are arranged.

28. A storing method for storing an ink jet recording head in which a plurality of ink ejection orifices are arranged, said method comprising the steps of:

providing a cap including an elastic member having a projecting portion with a strip like shape to press a face of the ink jet recording head at which face said plurality of ink ejection orifices are disposed, and a holder having an engage portion for engaging with the ink jet recording head so as to hold and fix said elastic member so that said projecting portion presses said face, and positioning said projecting portion so that a longitudinal direction of said projecting portion lies along a direction of the line in which said plurality of ink ejection orifices are arranged;

providing the ink jet recording head in which the plurality of ink ejection orifices are arranged; and installing said cap in said ink jet recording head so as to press said projecting portion against said face so that said projecting portion elastically deforms following a profile of said face to seal said plurality of ink ejection orifices.

* * * * *

UNITED STATES PATENT AND TRADEMARK OFFICE

CERTIFICATE OF CORRECTION

PATENT NO. : 5,648,802

DATED : July 15, 1997

INVENTOR(S) : TSUTOMU ABE

It is certified that error appears in the above-identified patent and that said Letters Patent is hereby corrected as shown below:

Title page item,

[56] REFERENCES CITED

U.S. Patent Documents
Insert: --5,164,748 11/1992 Katayanagi et al. .... 346/140R--.

Foreign Patent Documents
Insert: --3-234659 10/1991 Japan.--.
"63-12149" should read --63-21149--.
"3176156" should read --3-176156--.
"WO9108269" should read --WO9108267--.

[57] ABSTRACT

Line 8, "responsive" should read --response--.

COLUMN 1

Line 21, "drop let" should read --droplet--.
Line 23, "be" should read --the--.
Line 37, "above mentioned" should read --above-mentioned--.
Line 49, "above men-" should read --above-men---.
Line 52, "above mentioned" should read --above-mentioned--.

UNITED STATES PATENT AND TRADEMARK OFFICE

CERTIFICATE OF CORRECTION

PATENT NO. : 5,648,802

DATED : July 15, 1997

INVENTOR(S) : TSUTOMU ABE

It is certified that error appears in the above-identified patent and that said Letters Patent is hereby corrected as shown below:

COLUMN 2

Line 37, "above mentioned" should read --above-mentioned--.
Line 38, "to be" should be deleted.
Line 57, "be brought." should read --occur.--.
Line 64, "3A-3C" should read --3A and 3B--.

COLUMN 3

Line 2, "These" should read --This--.
Line 7, "is" should read --are--.
Line 13, "responsive" should read --response--.
Line 16, "3A-3C" should read --3A and 3B--.
Line 26, "which leads to" should read --there may occur--.
Line 29, "above mentioned" should read --above-mentioned--.

COLUMN 5

Line 13, "one dimensional" should read --one-dimensional--.
Line 35, "followings," should read --following,--.
Line 51, "above mentioned" should read --above-mentioned--.
Line 66, "perspectively" should read --respectively--.
Line 67, "an orifices" should read --orifices--.

UNITED STATES PATENT AND TRADEMARK OFFICE

CERTIFICATE OF CORRECTION

PATENT NO. : 5,648,802

DATED : July 15, 1997

INVENTOR(S) : TSUTOMU ABE

It is certified that error appears in the above-identified patent and that said Letters Patent is hereby corrected as shown below:

COLUMN 6

Line 12, "line." should read --like.--.
Line 17, "above mentioned" should read --above-mentioned--.
Line 18, "above mentioned" should read --above-mentioned--.
Line 25, "responsive" should read --response--.
Line 41, "responsive" should read --response--.
Line 45, "above mentioned" should read --above-mentioned--.

COLUMN 7

Line 11, "side" should read --sides--.
Line 13, "formed" should read --are formed--.
Line 27, "channels 16a" should read --channel 16a--.

COLUMN 8

Line 2, "in the following reasons" should read --as follows--.
Line 29, "goes" should read --go--.
Line 46, "above mentioned" should read --above-mentioned--.
Line 52, "responsive" should read --response--.

UNITED STATES PATENT AND TRADEMARK OFFICE

CERTIFICATE OF CORRECTION

PATENT NO. : 5,648,802

DATED : July 15, 1997

INVENTOR(S) : TSUTOMU ABE

It is certified that error appears in the above-identified patent and that said Letters Patent is hereby corrected as shown below:

COLUMN 9

Line 13, "above mentioned" should read --above-mentioned--.
Line 24, "above mentioned" should read --above-mentioned--.
Line 31, "above mentioned" should read --above-mentioned--.
Line 56, "above mentioned" should read --above-mentioned--.
Line 67, "responsive" should read --response--.

COLUMN 10

Line 4, "above mentioned" should read --above-mentioned--.
Line 38, "responsive" should read --response--.
Line 49, "above described" should read --above-described--.

COLUMN 11

Line 53, "consists" should read --consist--.

UNITED STATES PATENT AND TRADEMARK OFFICE

CERTIFICATE OF CORRECTION

PATENT NO. : 5,648,802

DATED : July 15, 1997

INVENTOR(S) : TSUTOMU ABE

It is certified that error appears in the above-identified patent and that said Letters Patent is hereby corrected as shown below:

COLUMN 12

Line 54, "requires" should read --require--.

COLUMN 13

Line 1, "form" should read --from--.
Line 2, "hand" should read --hard--.
Line 12, "is" should be deleted.
Line 32, "strip" should read --strip---.

COLUMN 14

Line 6, "strip" should read --strip---.
Line 8, "ejection" should read
--ejection orifices--.
Line 43, "strip" should read --strip---.
Line 59, "claimed" should read --as claimed--.
Line 61, "claim 10," should read --claim 16,--.
Line 63, "responsive" should read --response--.

UNITED STATES PATENT AND TRADEMARK OFFICE

CERTIFICATE OF CORRECTION

PATENT NO. : 5,648,802

DATED : July 15, 1997

INVENTOR(S) : TSUTOMU ABE

It is certified that error appears in the above-identified patent and that said Letters Patent is hereby corrected as shown below:

COLUMN 16

Line 7, "strip like" should read --strip-like--.

Signed and Sealed this

Twenty-sixth Day of May, 1998

*Attest:*

Bruce Lehman

BRUCE LEHMAN

*Attesting Officer*

*Commissioner of Patents and Trademarks*